US006402568B1

(12) United States Patent
Nagai

(10) Patent No.: US 6,402,568 B1
(45) Date of Patent: Jun. 11, 2002

(54) COMBINED-TYPE CONNECTOR

(75) Inventor: Kentaro Nagai, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/516,459

(22) Filed: Mar. 1, 2000

(30) Foreign Application Priority Data

Mar. 1, 1999 (JP) ..... 11-053224

(51) Int. Cl.[7] ..... H01R 13/502
(52) U.S. Cl. ..... 439/701; 739/717; 739/718
(58) Field of Search ..... 439/701, 715, 439/717, 718, 594, 595, 599

(56) References Cited

U.S. PATENT DOCUMENTS 3,848,951 A * 11/1974 Michaels et al. ..... 439/717
4,425,018 A * 1/1984 Stenz ..... 439/717
4,682,839 A * 7/1987 Bryce ..... 439/701
4,729,744 A * 3/1988 Bet et al. ..... 439/717
5,320,555 A * 6/1994 Okabe ..... 439/701
5,890,933 A * 4/1999 Okabe ..... 439/701
5,947,774 A * 9/1999 Abe ..... 439/701
5,957,732 A * 9/1999 Ito et al. ..... 439/752

* cited by examiner

*Primary Examiner*—Hien Vu
(74) *Attorney, Agent, or Firm*—Morgan, Lewis & Bockius LLP

(57) ABSTRACT

In a combined-type connector, two connector housings 21 and 22 are connected together in such a manner that opposed connecting surfaces 21*a*and 22*a* of the two connector housings are held against each other, and a plurality of partition walls 24 are formed on the upper connector housing 21, and separate terminal storage chambers 23, each receiving a terminal 26, from one another, and a plurality of partition walls 33 are formed on the lower connector housing 22 so as to be opposed to the partition walls 24, respectively. In a connecting position of the two connector housings 21 and 22, distal end surfaces of the partition walls 24 are substantially abutted respectively against distal end surfaces of the partition walls 33. The lower connector housing 22 is slidable relative to the upper connector housing 21 in a direction of extending of the partition walls 24 and 33, and when the lower connector housing is slid, the partition walls 33 slide respectively over the partition walls 24, so that the two connector housings 21 and 22 are located in the connecting position.

9 Claims, 8 Drawing Sheets

COMBINED-TYPE CONNECTOR

BACKGROUND OF THE INVENTION

This invention relates to a combined-type connector in which a plurality of connector housings, each having a plurality of terminals received therein, are connected together in a multi-stage manner to provide the combined-type connector.

FIGS. 8 to 12 show a combined-type connector (see Japanese Patent Application No. Hei.9-223764). FIG. 8 is a perspective view of this combined-type connector, which shows a condition before it is brought into a combined condition. FIG. 9 is an enlarged, perspective view of an important portion of an upper connector housing as viewed from the lower side thereof. FIG. 10 is an enlarged, perspective view of an important portion of a lower connector housing as viewed from the upper side thereof. FIG. 11 is a cross-sectional view of an important portion, which shows a condition in which press-connecting terminals are held in contact with partition walls. FIG. 12 is a cross-sectional view of an important portion, which shows a condition in which the press-connecting terminal is pressed and deformed by the partition wall.

In FIGS. 8 to 12, the combined-type connector 1 includes the upper connector housing 2 and the lower connector housing 3, and a lower surface 2*a* of the upper connector housing 2 and an upper surface 3*a* of the lower connector housing 3 serve respectively as connecting surfaces opposed to each other. A plurality of terminal storage chambers 4 are formed in the upper connector housing 2, and extend in a forward-rearward direction, and are juxtaposed in a right-left direction. These terminal storage chambers 4 are separated from one another by the partition walls 5 (shown in FIGS. 11 and 12). A rear portion of the lower surface (connecting surface) 2*a* of the upper connector housing 2 is open to provide an opening 6, and rear portions of the terminal storage chambers 4 are exposed through this opening 6. The press-connecting terminals 7 (shown in FIGS. 11 and 12) are received in the terminal storage chambers 4, respectively, and one end portion of a wire W is press-connected to a wire press-connecting portion 7*a* formed at a rear portion of each press-connecting terminal 7. The wire press-connecting portion 7*a* is bent into a generally U-shape, and distal ends of opposed side walls thereof project upwardly beyond the partition walls 5.

On a front portion of the lower surface (connecting surface) 2*a* of the upper connector housing 2, three first front retaining projections 8 of a generally trapezoidal cross-section are formed to extend in the forward-rearward direction, one of these projections 8 being disposed at a central portion of this front portion whereas the other two projections 8 are disposed respectively on opposite sides of this central projection 8, and are spaced a predetermined distance therefrom. Second front retaining projections 9 are formed respectively on opposite ends of the front portion of the lower surface 2*a* of the upper connector housing 2. As best shown in FIG. 9, each second front retaining projection 9 includes a downwardly-extending, introducing rib 9*a* of a semi-circular shape, an introducing tapering convex portion 9*b* extending obliquely from a distal end of the introducing rib 9*a,* and a flat convex portion 9*c* extending horizontally from the bottom of the introducing tapering convex portion 9*b*. Rear retaining projections 10, each in the form of an engagement pole, are provided respectively on opposite side surfaces of the upper connector housing 2 at the rear portion thereof.

A plurality of terminal storage chambers 4 are formed in the lower connector housing 3, and extend in the forward-rearward direction, and are juxtaposed in the right-left direction. A rear portion of a lower surface of the lower connector housing 3 is open to provide an opening 6, and rear portions of the terminal storage chambers 4 are exposed through this opening 6. Similarly the upper connector housing 2, press-connecting terminals (not shown) are received in the terminal storage chambers 4 of the lower connector housing 3, respectively.

A cover 11 is connected to the lower side of the lower connector housing 3 through hinge portions (not shown). The opening 6 can be closed by this cover 11. A plurality of partition walls 12 are formed on a rear portion of the upper surface (connecting surface) 3*a* of the lower connecting housing 3 so as to be opposed respectively to the plurality of partition walls 5 on the upper connector housing 2. A wire position-limiting projection 13 (shown in FIGS. 11 and 12) is formed between any two adjacent partition walls 12.

Three first front retaining recesses 14 of a generally inverted trapezoid-shaped cross-section are formed in a front portion of the upper surface (connecting surface) 3*a* of the lower connector housing 3, one of these recesses 14 being disposed at a central portion of this front portion whereas the other two recesses 14 are disposed respectively on opposite sides of this central recess 14, and the other recesses 14 are spaced a predetermined distance therefrom. Second front retaining recesses 15 are formed respectively in opposite ends of the front portion of the upper surface 3*a* of the lower connector housing 3. As best shown in FIG. 10, each second front retaining recess 15 includes a guide tapering recess portion 15*a* for receiving the introducing rib 9*a* and the introducing tapering convex portion 9*b,* and a horizontal recess portion 15*b* for receiving the flat convex portion 9*c*. Rear retaining arms 16 of an elastic nature are formed respectively on opposite side surfaces of the lower connector housing 3 at the rear portion thereof, and each of the rear retaining arms 16 has a rear retaining hole 17.

In the above construction, the press-connecting terminals 7 are received respectively in the terminal storage chambers 4 formed in the connector housings 2 and 3, and the wire W is connected at one end portion to each of the press-connecting terminals 7, and thereafter the opening 6 in the lower connector housing 3 is closed by the cover 11. Then, the upper connector housing 2 is set on a combining jig (not shown), with its lower surface 2*a* directed upwardly, and then the lower connector housing 3 is placed on the thus set upper connector housing 2 from the upper side, with the upper surface 3*a* thereof directed downwardly. When placing the lower connector housing on the upper connector housing, the first front retaining projections 8, the second front retaining projections 9 and the rear retaining projections 10 of the upper connector housing 2 are generally positioned with respect to the first front retaining recesses 14, the second front retaining recesses 15 and the rear retaining arms 16 of the lower connector housing 3, respectively.

Then, the lower connector housing 3 is pressed downwardly, so that the opposed connecting surfaces of the two connector housings 2 and 3 are moved toward each other, and therefore in this connecting position, the first front retaining projections 8 and the second front retaining projections 9 are fitted into the first front retaining recesses 14 and the second front retaining recesses 15, respectively. Also the rear retaining projections 10 are retainingly engaged respectively in the rear retaining holes 17 since the rear retaining arms 16 are elastically deformed. Therefore, the two connector housings 2 and 3 are combined together.

In accordance with the movement of the two connector housings 2 and 3 toward the connecting position, the partition walls 12 are moved toward the partition walls 5, respectively, and are substantially held against the partition walls 5 at their respective distal ends. Therefore, the terminal storage chambers 4 are substantially completely separated or isolated from one another, and the short-circuiting between the adjacent press-connecting terminals 7 is prevented.

However, in the above combined-type connector 1, the connecting surfaces of the two connector housings 2 and 3 are first located in opposed, spaced relation to each other, and then the connecting surfaces are gradually moved toward each other from the opposed, spaced positions so that the two connector housings 2 and 3 can be connected together. The positioning of the two connector housings 2 and 3 relative to each other during the connecting operation is unstable.

Namely, in the right-left direction, the positioning of the front portions of the two connector housings 2 and 3 is effected by inserting the first front retaining projections 8 respectively into the first front retaining recesses 14. In the forward-rearward direction the positioning of these front portions is effected by inserting the front second retaining projections 9 respectively into the front second retaining recesses 15. Therefore, there is no problem. However, the positioning of the rear portions of the two connector housings 2 and 3 is effected only by engaging the rear retaining projections 10 respectively with the elastically-deformable rear retaining arms 16. Therefore, these rear portions can be easily displaced in the right-left direction which is the direction of elastic deformation of the rear retaining arms 16.

When the two connector housings 2 and 3 are moved toward the connecting position, with the lower connector housing 3 displaced in the right-left direction from the proper position, the partition walls 12 of the lower connector housing 3 abut against the wire press-connecting portions 7*a* of the press-connecting terminals 7 as shown in FIG. 11, and the wire press-connecting portions 7*a* are bent by a pressing force applied from the partition walls 12. When the wire pressconnecting portion 7*a* of the press-connecting terminal 7 is bent outwardly as shown in FIG. 12, there is a fear that this wire press-connecting portion 7*a* contacts the adjacent press-connecting terminal 7, thus causing the short-circuiting.

SUMMARY OF THE INVENTION

The present invention has been made in order to solve the above problem, and an object of the invention is to provide a combined-type connector in which the short-circuiting between adjacent terminals during a connecting operation is prevented.

According to the present invention, there is provided a combined-type connector including:

at least first and second connector housings;

said first and second connector housings being respectively provided with first and second terminal storage chambers, said first and second connector housings being adapted to stack one on the other;

first partition walls, on said first connecting housings, for defining said first terminal storage chambers;

second partition walls, on said second connecting housings, for defining said second terminal storage chambers;

wherein first distal end surfaces of said first partition walls are substantially abutted respectively against second distal end surfaces of said second partition walls;

wherein said first connector housing is slidable relative to said second connector housing in a sliding direction parallel to a direction in which each said second partition walls extend; and wherein said first connector housing is slidably moved relative to said second connector housing in said sliding direction to a connecting position.

In this combined-type connector, when the other connector housing is slid relative to the one connector housing, the partition walls on the other connector housing move or slide respectively over the partition walls on the one connector housing, and therefore even if the partition walls on the other connector housing are displaced relative to the partition walls on the one connector housing in the direction perpendicular to the direction of extending of the partition walls, so that the partition walls on the other connector housing contact the terminals, these terminals will not be bent outwardly.

In the combined-type connector of the invention, front lock mechanism are provided respectively at front end portions of the two connector housings in a sliding direction, and rear lock mechanism are provided respectively at rear end portions of the two connector housings in the sliding direction, and the front lock mechanism, as well as the rear lock mechanism, are engaged with each other in the connecting position of the two connector housings to connect the two connector housings together, and position lock mechanism are provided respectively at the two connector housings, and are engaged with each other in the connecting position of the two connector housings to position the two connector housings relative to each other in the sliding direction.

In this combined-type connector, when the sliding movement is effected, the two connector housings are positioned relative to each other in the connecting position by the position lock mechanism, and also the two connector housings are connected together at their front and rear portions by the front lock mechanism and the rear lock mechanism.

In the combined-type connector of the invention, the front lock mechanism on the one connector housing comprises front projections which are formed on the connecting surface of the one connector housing, and extend in the sliding direction, and the front lock mechanism on the other connector housing includes front recesses which are formed in the connecting surface of the other connector housing, and have their one ends open to a front end surface of the other connector housing in the sliding direction, and the front projections are engageable in the front recesses, respectively; and the rear lock mechanism on the one connector housing comprises rear projections, and the rear lock mechanism on the other connector housing comprises engagement arms, and each of the engagement arms has an engagement hole, and the rear projections are engaged only with the engagement arms, respectively, when the sliding movement is effected, and when the engagement arms abut respectively against the rear projections during the sliding movement of the other connector housing, the engagement arms are elastically deformed to allow the rear projections to slide, and when the other connector housing slides into the connecting position, the engagement arms are elastically restored into their respective initial positions, so that the rear projections are engaged in the engagement holes, respectively.

In this combined-type connector, slightly before the two connector housings reach the connecting position during the above sliding movement, the front projections of the front lock mechanism begin to be engaged respectively in the front recesses, and also the engagement arms of the rear lock mechanism abut respectively against the rear projections, and begin to be elastically deformed.

In the combined-type connector of the invention, at least one of each engagement arm and each rear projection has a slanting surface formed on that side thereof directed in the sliding direction.

In this combined-type connector, at least one of the engagement arm and the rear projection has the slanting surface, and therefore even if the two connector housings are displaced with respect to each other (that is, disposed out of registry with each other) in the direction perpendicular to the sliding direction, the slanting surface serves as a guide surface so as to correct this misregistration. And besides, since the rear projection and the engagement arm abut against each other through the slanting surface, the pressing force from the rear projection acts on the engagement arm in a direction to easily elastically deform the engagement arm.

DETAILED DESCRIPTION OF PREFERRED EMBODIMENTS

One preferred embodiment of the present invention will now be described with reference to the drawings.

Figure 1:
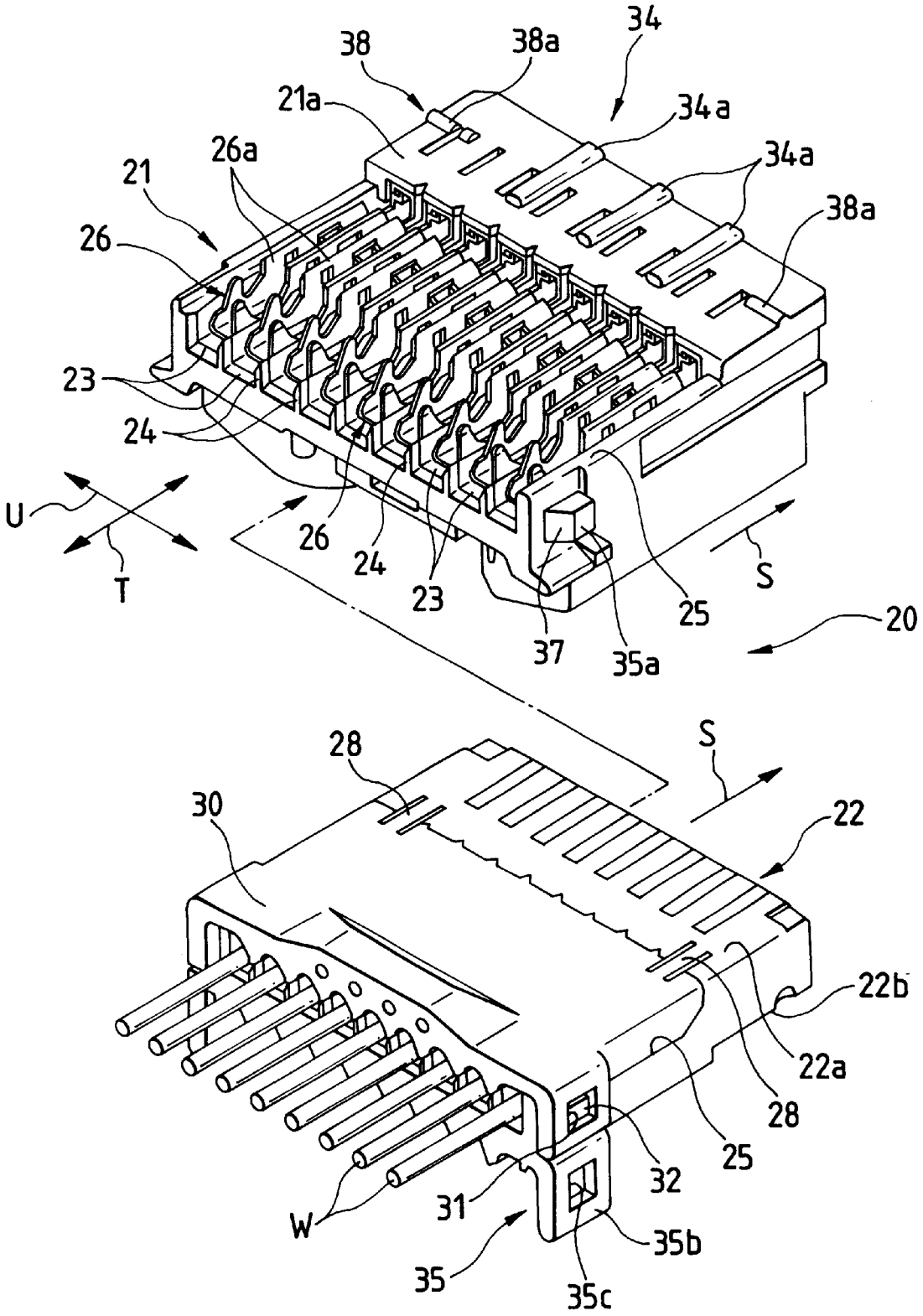
FIG. 1 is a perspective view of one preferred embodiment of a combined-type connector of the invention, showing a condition before it is brought into a combined condition.
Figure 2:
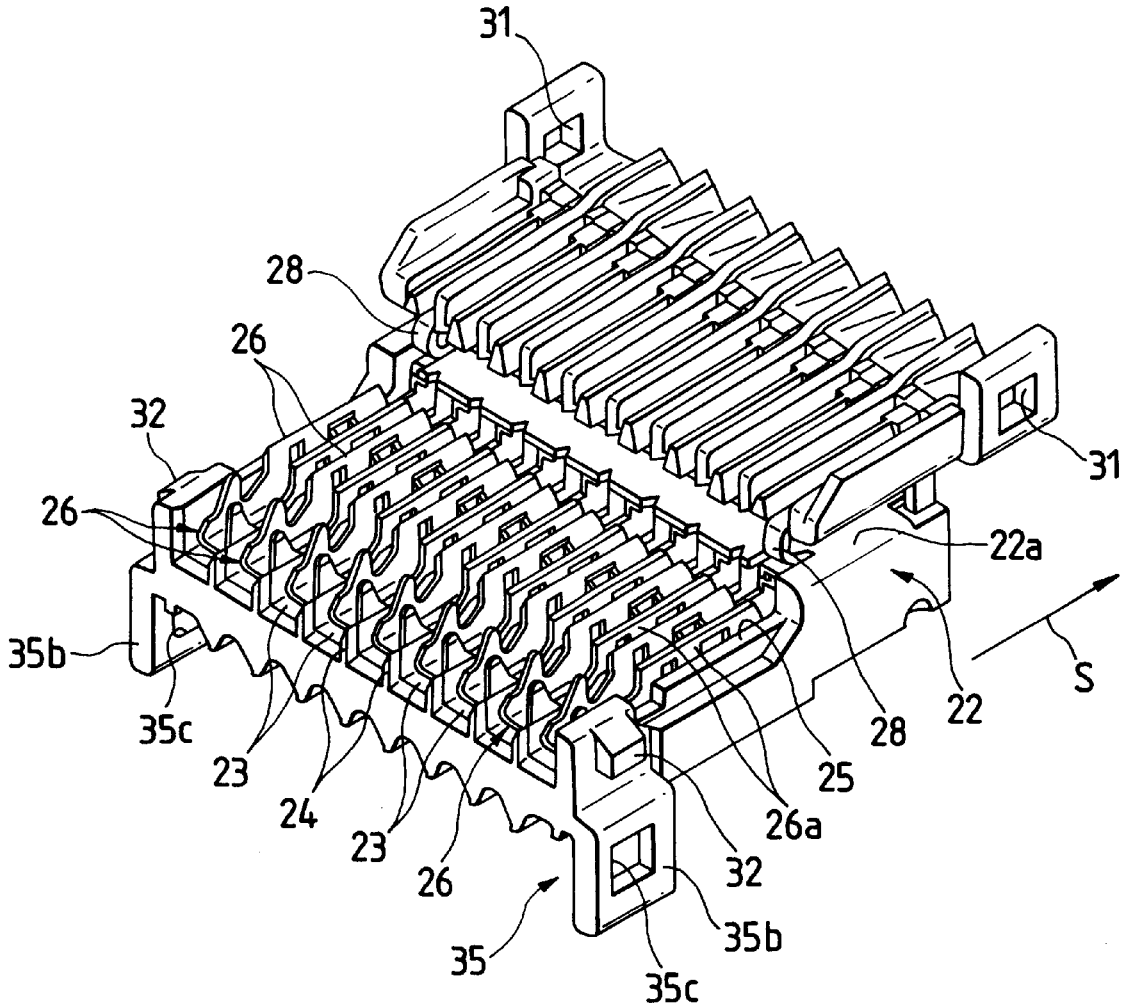
FIG. 2 is a perspective view of a lower connector housing of the above embodiment as viewed from the lower side thereof.
Figure 3:
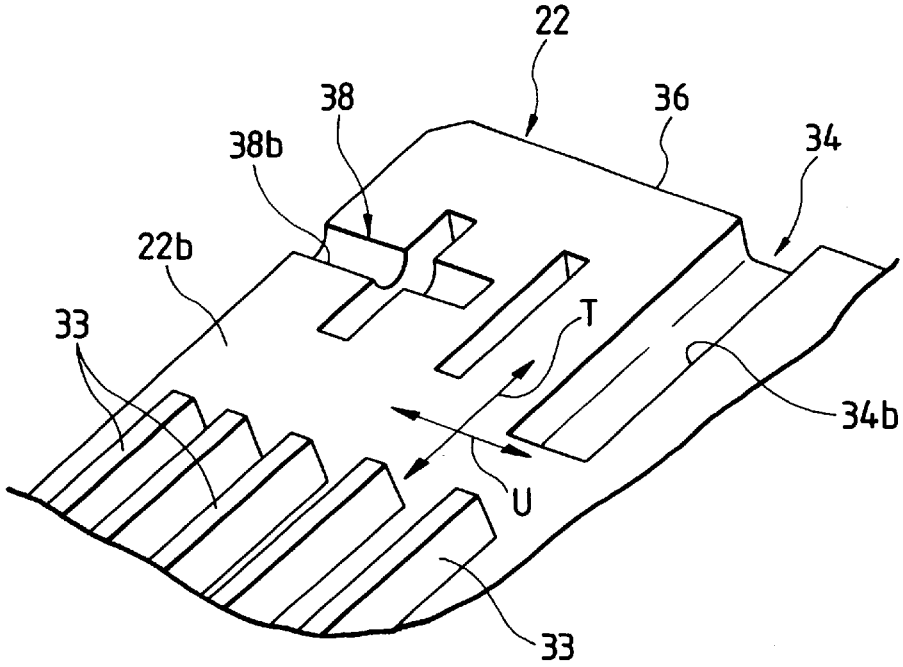
FIG. 3 is a perspective view of a portion of the lower connector housing at the upper side thereof.
Figure 4:
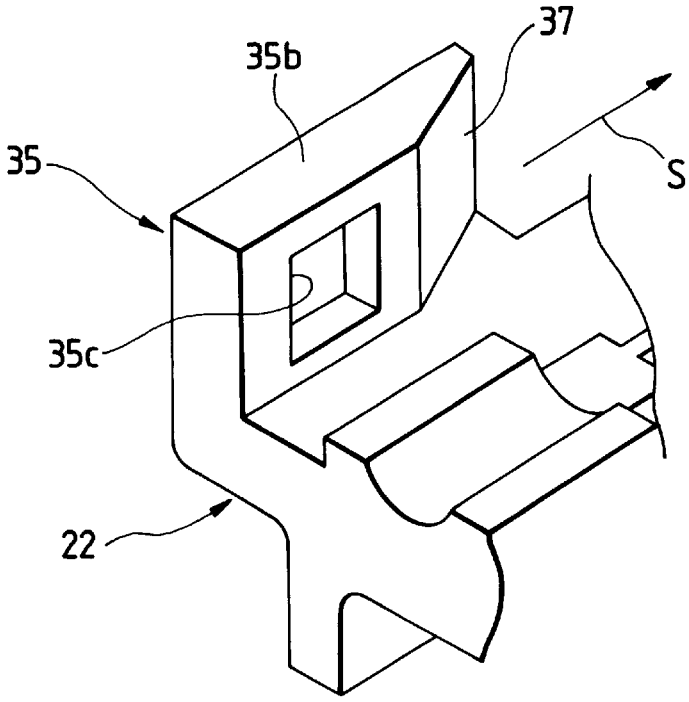
FIG. 4 is a perspective view of a portion of the lower connector housing at the upper side thereof.
Figure 5:
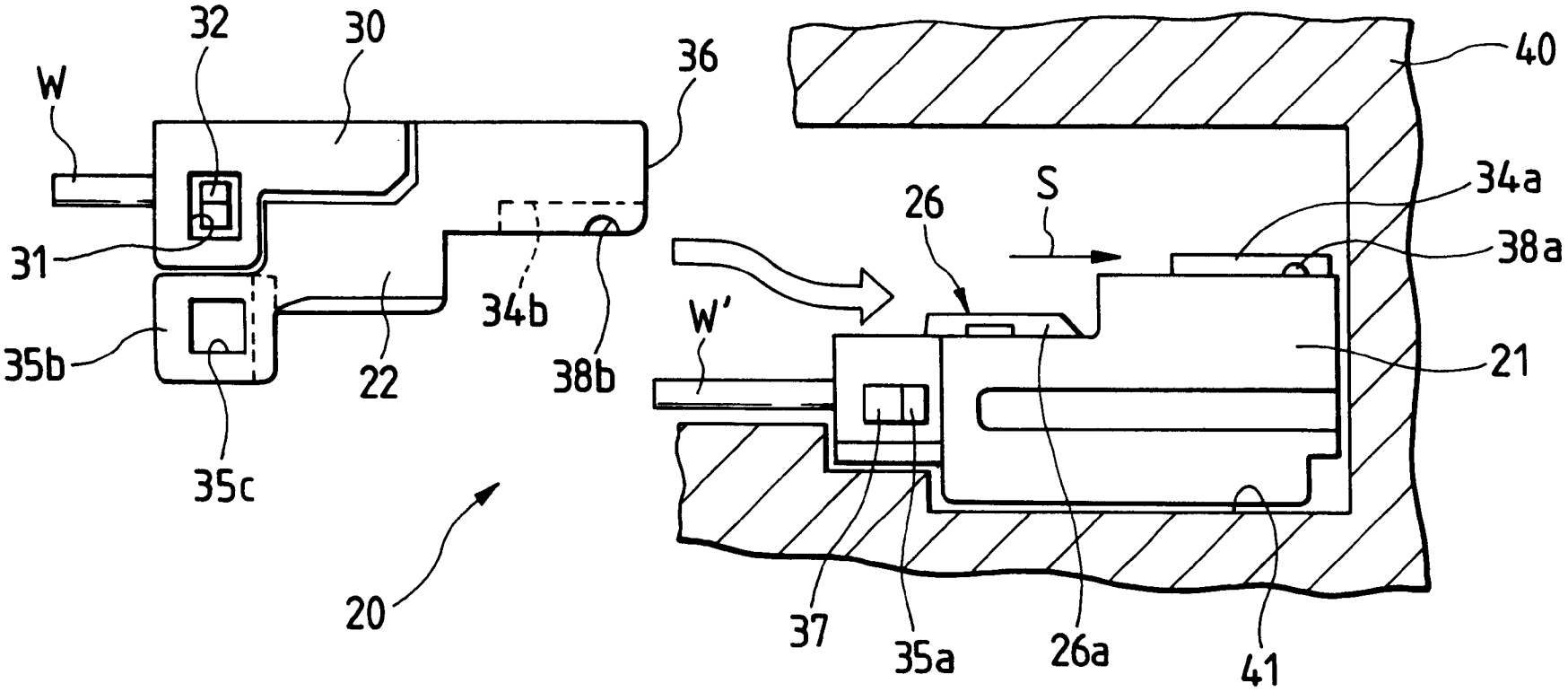
FIG. 5 is a side-elevational view showing a process of a combined-type connector-connecting operation.
Figure 6:
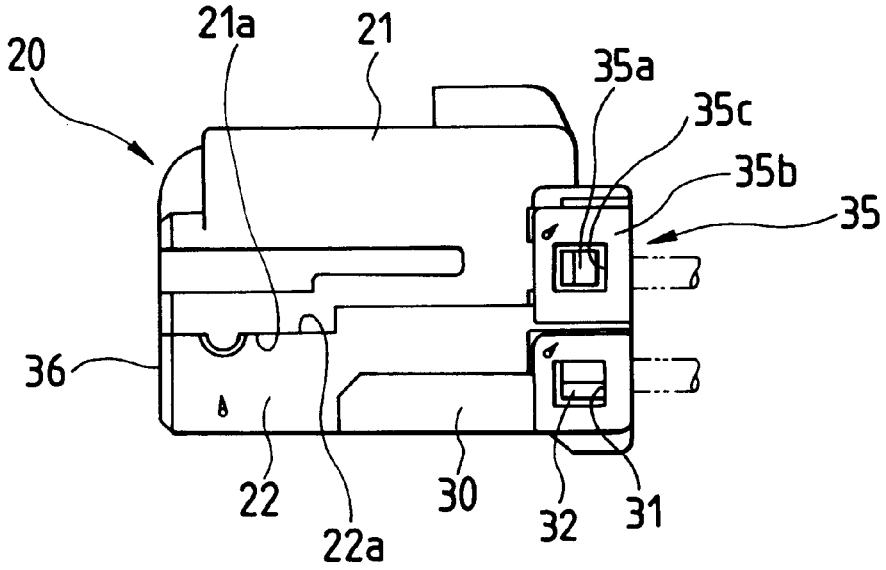
FIG. 6 is a side-elevational view showing the combined-type connector in its combined condition.
Figure 7:
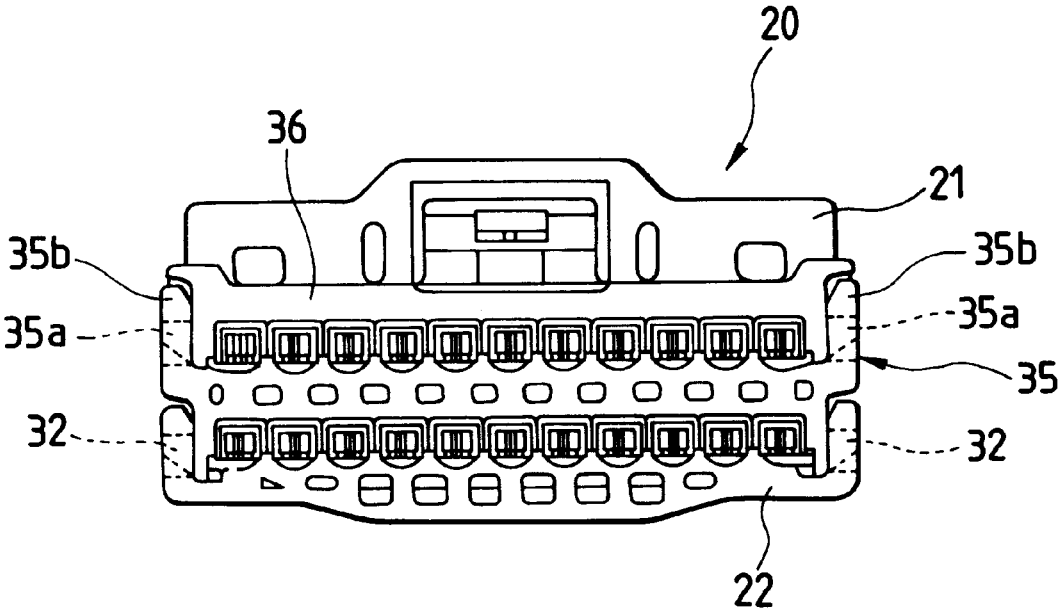
FIG. 7 is a front-elevational view showing the combined-type connector in its combined condition.
Figure 8:
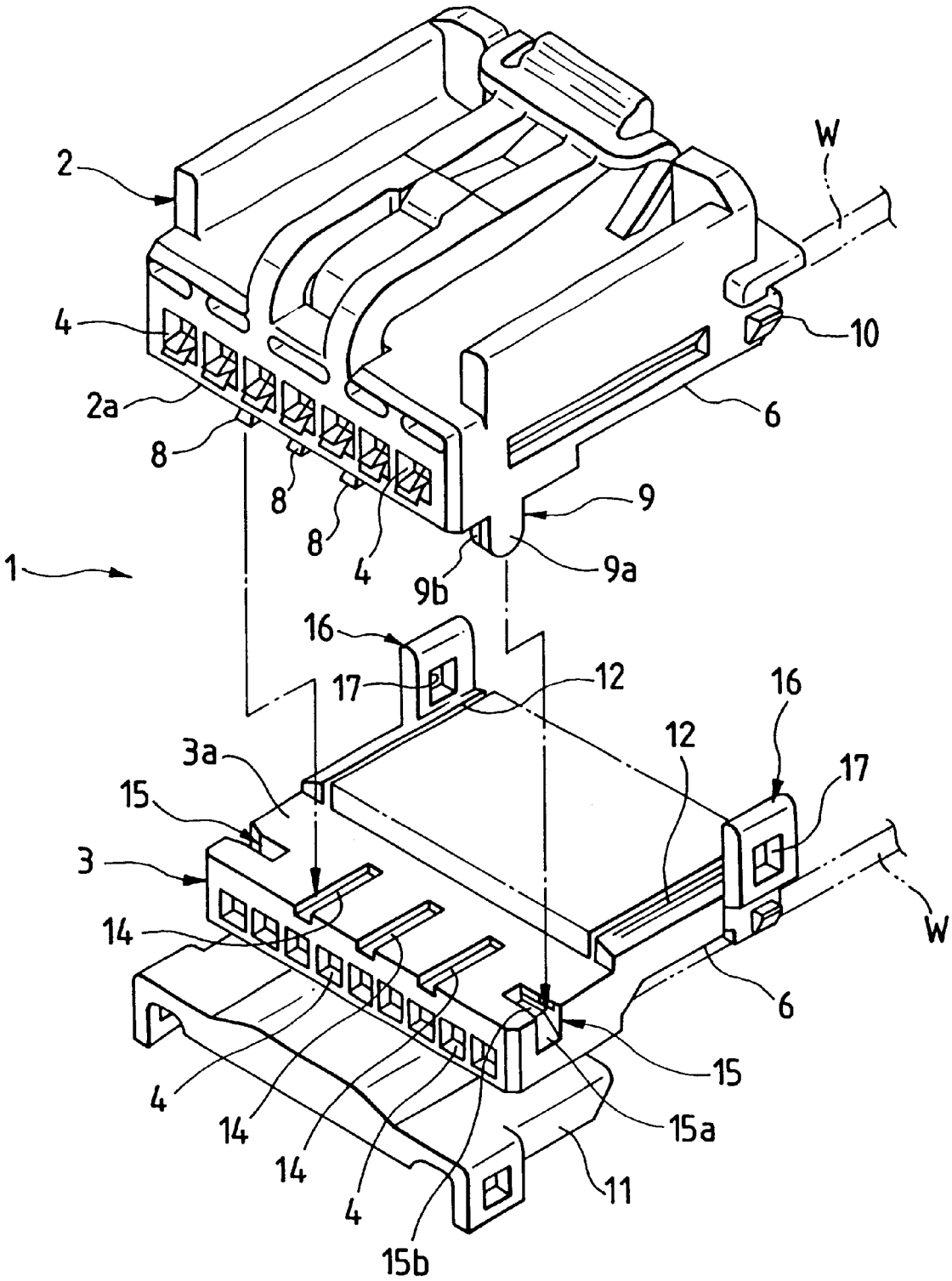
FIG. 8 is a perspective view of a combined-type connector, showing a condition before it is brought into a combined condition.
Figure 9:
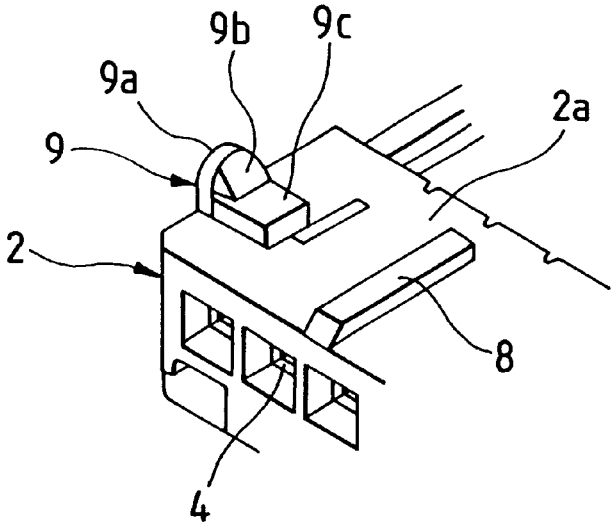
FIG. 9 is an enlarged, perspective view of an important portion of an upper connector housing of the connector as viewed from the lower side thereof.
Figure 10:
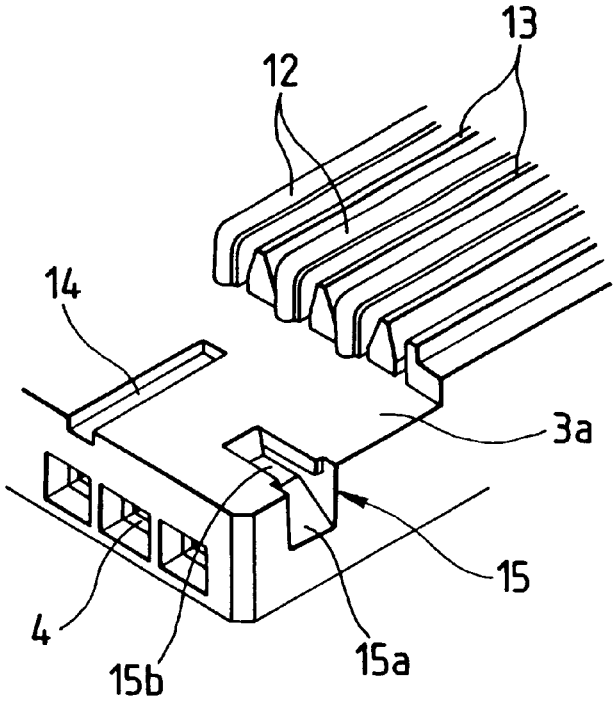
FIG. 10 is an enlarged, perspective view of an important portion of a lower connector housing of the connector as viewed from the upper side thereof.
Figure 11:
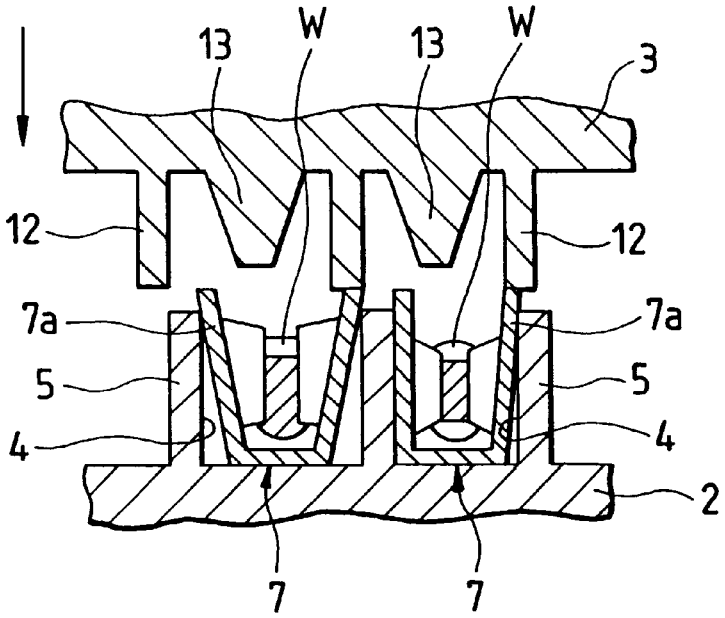
FIG. 11 is a cross-sectional view of an important portion of the connector, showing a condition in which press-connecting terminals are held in contact with partition walls.
Figure 12:
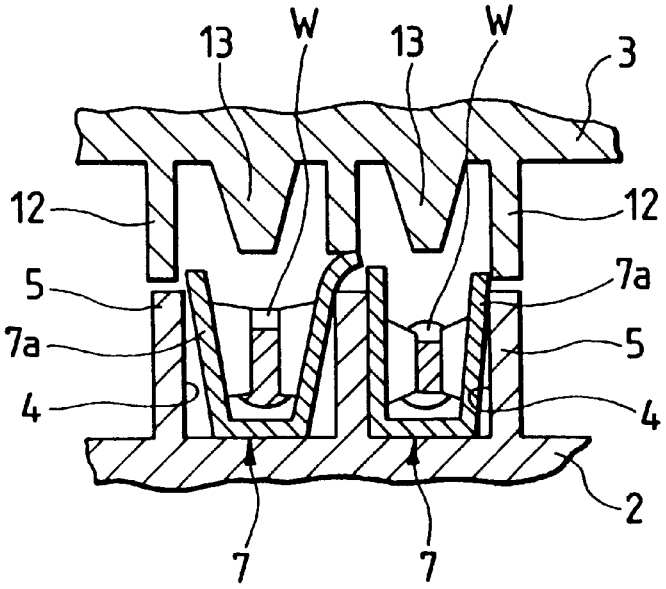
FIG. 12 is a cross-sectional view of an important portion of the connector, showing a condition in which the press-connecting terminal is pressed and deformed by the partition wall.

FIG. 1 is a perspective view of one preferred embodiment of a combined-type connector of the invention, showing a condition before it is brought into a combined condition, FIG. 2 is a perspective view of a lower connector housing as viewed from the lower side thereof. FIG. 3 is a perspective view of a portion of the lower connector housing at the upper side thereof. FIG. 4 is a perspective view of a portion of the lower connector housing at the upper side thereof. FIG. 5 is a side-elevational view showing a process of a combined-type connector-connecting operation. FIG. 6 is a side-elevational view showing the combined-type connector in its combined condition. And FIG. 7 is a front-elevational view showing the combined-type connector in its combined condition. In FIGS. 1 and 2, the two connector housings 21 and 22 are shown with their lower surfaces directed upwardly for better understanding of the connecting operation.

In FIGS. 1 to 7, the combined-type connector 20 includes the upper connector (one connector housing) 21, and the lower connector housing (the other connector housing) 22. A lower surface 21*a* of the upper connector housing 21 and an upper surface 22*b* of the lower connector housing 22 serve respectively as connecting surfaces opposed to each other. The lower connector housing 22 is slidable relative to the upper connector housing 21 in a direction T that is parallel to a direction in which each partition wall 24 extends (that is, in a forward-rearward direction).

A plurality of terminal storage chambers 23 are formed in the upper connector housing 21, and extend in the forward-rearward direction, and are juxtaposed in a right-left direction, and these terminal storage chambers 23 are separated from one another by partition walls 24. A rear portion of the lower surface (connecting surface) 21*a* of the upper connector housing 21 is open to provide an opening 25, and rear portions of the terminal storage chambers 23 are exposed through this opening 25. Press-connecting terminals 26 are received in the terminal storage chambers 23, respectively. One end portion of a wire W' (see FIG. 5) is press-connected to a wire press-connecting portion 26*a* formed at a rear portion of each press-connecting terminal 26. The wire press-connecting portion 26*a* is bent into a generally U-shape, and distal ends of opposed side walls of the wire press-connecting portion 26*a* project upwardly beyond the partition walls 24.

A plurality of terminal storage chambers 23 are formed in the lower connector housing 22, and extend in the forward-rearward direction, and are juxtaposed in the right-left direction, and these terminal storage chambers 23 are separated from one another by partition walls 24. A rear portion of the lower surface 22*a* of the lower connector housing 22 is open to provide an opening 25, and rear portions of the terminal storage chambers 23 are exposed through this opening 25. As described above for the upper connector housing, press-connecting terminals 26 are received in the terminal storage chambers 23, respectively. One end portion of a wire W is press-connected to a wire press-connecting portion 26*a* formed at a rear portion of each press-connecting terminal 26.

A cover 30 is connected to the lower surface 22*a* of the lower connector housing 22 through hinge portions 28, and the opening 25 can be closed by this cover 30 as shown in FIG. 1. Retaining holes 31 are formed respectively in opposite side surfaces of the cover 30 at a distal end portion thereof, and retaining projections 32 are formed respectively on opposite side surfaces of the lower connector housing 22 at the rear end portion thereof. When the cover 30 is moved into its closed position, the retaining projections 32 are retainingly engaged respectively in the retaining holes 31, thereby locking the cover 30.

As shown in FIG. 3, a plurality of partition walls 33 are formed on a rear portion of the upper surface (connecting surface) 22*b* of the lower connecting housing 22 so as to be opposed respectively to the plurality of partition walls 24 on the upper connector housing 21.

A front lock mechanism 34 is provided at the front end portions of the upper and lower connector housings 21 and 22 in the sliding direction. Rear lock mechanism 35 is provided at the rear end portions of the two connector housings 21 and 22 in the sliding direction. The two connector housings 21 and 22 are connected together in a connecting position by the front lock mechanism 34 and the rear lock mechanism 35.

The front lock mechanism 34 includes three front projection 34*a* (see FIG. 1), which are formed on a central portion of the lower surface (connecting surface) 21*a* of the upper connector housing 21 and extend in the sliding direction (the extending direction T), and three front recesses 34*b* (see FIG. 3) which are formed in a central portion of the upper surface (connecting surface) 22*b* of the lower connector housing 22 and have their one ends open to a slide front surface 36. The front projections 34*a* are engageable in the front recesses 34*b,* respectively. Each front projection 34*a* is gradually decreasing in width from its distal end surface to its proximal portion, and each front recess 34*b* is in the form of a dovetail groove gradually increasing in width from its open side to its bottom.

The rear lock mechanism 35 includes rear projections 35*a,* formed respectively on the opposite side surfaces of the upper connector housing 21, and elastic engagement arms 35*b* which are formed on and extend upwardly from the opposite side surfaces of the lower connector housing 22, respectively. The rear projections 35*a* are located to the brought into abutment only against with the engagement arms 35*b,* respectively, when the sliding movement is effected. The engagement arms 35*b* have engagement holes 35*c,* respectively, in which the rear projections 35*a* are engageable, respectively. When the pair of engagement arms 35*a* abut respectively against the rear projections 35*a* during the sliding movement of the lower connector housing 22, the engagement arms 35*b* are elastically deformed to allow the respective rear projections 35*a* to slide, and when the lower connector housing 22 slides into the connecting position, the pair of engagement arms 35*b* are elastically restored into their respective initial positions, so that the rear projections 35*a* are engaged in the engagement holes 35*c,* respectively.

As shown in FIG. 1, a rear surface of each rear projection 35*a* in the sliding direction S, against which the engagement arm 35*b* can abut, is formed into a slanting surface 37. As shown in FIG. 4, a front surface of each engagement arm 35*b* in the sliding direction S, against which the rear projection 35*a* can abut, is also formed into a slanting surface 37.

Position lock mechanism 38 is provided at the front end portions of the upper and lower connector housings 21 and 22 in the sliding direction S, and the positioning of the two connector housings 21 and 22 relative to each other in the sliding direction S is determined by this position lock mechanism 38. The position lock mechanism 38 includes position lock projections 38*a* (see FIG. 1),which are formed respectively on opposite side portions of the lower surface (connecting surface) 21*a* of the upper connector housing 21 and are extend in a direction U (perpendicular to the extending direction T) perpendicular to the sliding direction S, and position lock recesses 38*b* (see FIG. 3) which are formed respectively in opposite side portions of the upper surface (connecting surface) 22*b* of the lower connector housing 22. When the two connector housings 21 and 22 are located in the connecting position, the position lock projections 38*a* are engaged with the position lock recesses 38*b,* respectively.

In the above construction, the press-connecting terminals 26 are received respectively in the terminal storage chambers 23 in the two connector housings 21 and 22, and one end portions of the wires W, W' are connected to these press-connecting terminals 26, respectively. Thereafter, the opening 25 in the lower surface of the lower connector housing 22 is closed by the cover 30.

Then, as shown in FIG. 5, the upper connector housing 21 is set in a recess 41 in a combining jig 40, with the lower surface 21*a* thereof directed upwardly, and the lower connector housing 22 is slid over the lower surface 21*a* of the thus set upper connector housing 21, with the upper surface 22*b* thereof directed downwardly, such that the lower surface 21*a* opposes the upper surface 22*b*.

As this sliding movement proceeds, the pair of engagement arms 35*b* on the lower connector housing 22 abut respectively against the pair of rear projections 35*a* on the upper connector housing 21, and then the engagement arms 35*b* are elastically deformed outwardly by the rear projections 35*a,* respectively, to allow the lower connector housing 22 to slide. Thereafter, when the lower connector housing 22 slides into the connecting position relative to the upper connector housing 21, the pair of position lock projections 38*a* are engaged respectively in the pair of position lock recesses 38*b,* thereby preventing the further sliding movement of lower connector housing 22. In the connecting position, the front projections 34*a* are completely engaged respectively in the front recesses 34*b,* and also the pair of engagement arms 35*b* are elastically restored into their respective initial positions, so that the pair of rear projections 35*a* are engaged in the pair of engagement holes 35*c,* respectively. As a result, the two connector housings 21 and 22 are combined together.

When the lower connector housing 22 slides into the connecting position, the two connector housings 21 and 22 are positioned relative to each other in the sliding direction S by the position lock mechanism 38, and also the two connector housings 21 and 22 are connected together at their front and rear portions by the front lock mechanism 34 and the rear lock mechanism 35, and therefore the two connector housings are firmly connected together. Particularly in this embodiment, each front projection 34*a,* which is narrower at its proximal portion than at its distal end surface, is fitted in the front recess 34*b* which is wider at its bottom than at its open side, and therefore the two connector housings, are effectively prevented from be misaligned relative to each other during the sliding movement. The positive engagement between the projection 34*q* and recess 34*b* effectively prevents rattle clamping of two connector housings when connector housings completely combine together.

During the above sliding movement, the partition walls 33 on the lower connector housing 22 respectively are kept in contact with the partition walls 24 on the upper connector housing 21. Therefore, even if the partition walls 33 are displaced relative to the partition walls 24 in the direction U perpendicular to the extending direction T, so that the partition walls 33 on the lower connector housing 22 may contact the press-connecting terminals 26, these press-connecting terminals 26 will not be bent outwardly although these terminals 26 may be flexed toward the inner sides of the respective terminal storage chambers 23. Then, the distal end surfaces of the partition walls 33 on the lower connector housing 22 are gradually corrected in a position with respect to the distal end surfaces of the respective partition walls 24 on the upper connector housing 21 without interfering the press-connecting terminals 26. In the connecting position, the partition walls 24 are completely aligned in registry with the partition walls 33, respectively. Therefore, the short-circuiting between the adjacent press-connecting terminals 26 associated the connecting operation is prevented.

Slightly before the two connector housings reach the connecting position during the above sliding movement, the front projections 34*a* of the front lock mechanism 34 begin to be engaged respectively in the front recesses 34*b,* and also the engagement arms 35*b* of the rear lock mechanism 35 abut respectively against the rear projections 35*a,* and begin to be elastically deformed. Therefore, the load is not so large at the time of starting the sliding movement when the largest sliding force is required, and therefore the sliding movement can be effected smoothly.

Each rear projection 35*a* and each engagement arm 35*b* have the slanting surfaces 37, respectively, and therefore even if the two connector housings 21 and 22 are displaced with respect to each other (that is, disposed out of registry with each other) in the direction perpendicular to the sliding direction during the sliding movement, the slanting surfaces 37 serve as guide surfaces so as to correct this misregistration. And besides, since the rear projection 35*a* and the engagement arm 35*b* abut against each other through their slanting surfaces 37, the pressing force from the rear projection 35*a* acts on the engagement arm 35*b* in a direction to easily elastically deform the engagement arm 35*b,* so that the sliding movement can be effected more smoothly.

In the above embodiment, the upper connector housing 21 is fixed, and the lower connector housing 22 is slid. However, the lower connector housing 22 may be fixed so that the upper connector housing 21 can be slid, or the two connector housings 21 and 22 may be both slid.

In the above embodiment, although the slanting surfaces 37 are formed on the rear projection 35*a* and the engagement arm 35*b,* respectively, the slanting surface 37 may be formed on one of them. However, when the slanting surfaces 37 are formed on the rear projection 35*a* and the engagement arm 35*b,* respectively, a large displacement (misregistration) in the direction U perpendicular to the sliding direction S can be dealt with.

In the above embodiment, the front projections 34*a* and the front recesses 34*b* of the front lock mechanism 34 may be provided at the lower and upper connector housings, respectively. Also, the rear projections 35*a* and the engagement arms 35*b* of the rear lock mechanism 35 may be provided at the lower and upper connector housings, respectively. Further, the position lock projections 38*a* and the position lock recesses 38*b* of the position lock mechanism 38 may be provided at the lower and upper connector housings, respectively. However, the positions, sizes and so on should be taken into consideration so that a large load will not develop when effecting the sliding movement.

In the above embodiment, although the combined-type connector 20 includes the two (upper and lower) connector housings 21 and 22 stacked together, the invention can be applied to a combined-type connector including three or more connector housings stacked together.

As described above, in the invention, the other connector housing is slidable relative to the one connector housing in the direction of extending of the partition walls, and when the other connector housing is slid, the partition walls on the other connector housing slide respectively over the partition walls on the one connector housing, so that the two connector housings are located in the connecting position. With this construction, when the other connector housing is slid relative to the one connector housing, the partition walls on the other connector housing move or slide respectively over the partition walls on the one connector housing, and therefore even if the partition walls on the other connector housing are displaced relative to the partition walls on the one connector housing in the direction perpendicular to the direction of extending of the partition walls, so that the partition walls on the other connector housing contact the terminals, these terminals will not be bent outwardly, and the short-circuiting between the adjacent terminals during the connecting operation is prevented.

In the combined-type connector of the invention, the front lock mechanism are provided respectively at the front end portions of the two connector housings in the sliding direction, and the rear lock mechanism are provided respectively at the rear end portions of the two connector housings in the sliding direction, and the front lock mechanism, as well as the rear lock mechanism, are engaged with each other in the connecting position of the two connector housings to connect the two connector housings together, and the position lock mechanism are provided respectively at the two connector housings, and are engaged with each other in the connecting position of the two connector housings to position the two connector housings relative to each other in the sliding direction. Therefore, when the sliding movement is effected, the two connector housings are positioned relative to each other in the connecting position by the position lock mechanism, and also the two connector housings are connected together at their front and rear portions by the front lock mechanism and the rear lock mechanism, and therefore the two connector housings are firmly connected together in the proper connecting position.

In the combined-type connector of the invention, the front lock mechanism on the one connector housing includes the front projections which are formed on the connecting surface of the one connector housing, and extend in the sliding direction, and the front lock mechanism on the other connector housing includes the front recesses which are formed in the connecting surface of the other connector housing, and have their one ends open to the front end surface of the other connector housing in the sliding direction, and the front projections are engageable in the front recesses, respectively, and the rear lock mechanism on the one connector housing includes the rear projections, and the rear lock mechanism on the other connector housing includes the engagement arms, and each of the engagement arms has the engagement hole, and the rear projections are engaged only with the engagement arms, respectively, when the sliding movement is effected, and when the engagement arms abut respectively against the rear projections during the sliding movement of the other connector housing, the engagement arms are elastically deformed to allow the rear projections to slide, and when the other connector housing slides into the connecting position, the engagement arms are elastically restored into their respective initial positions, so that the rear projections are engaged in the engagement holes, respectively. Therefore, slightly before the two connector housings reach the connecting position during the above sliding movement, the front projections of the front lock mechanism begin to be engaged respectively in the front recesses, and also the engagement arms of the rear lock mechanism abut respectively against the rear projections, and begin to be elastically deformed, and therefore the load is not so large at the time of starting the sliding movement when the largest sliding force is required, and therefore the sliding movement can be effected smoothly.

In the combined-type connector of the invention, at least one of each engagement arm and each rear projection has the slanting surface formed on that side thereof directed in the sliding direction. Thus, at least one of the engagement arm and the rear projection has the slanting surface, and therefore even if the two connector housings are displaced with respect to each other (that is, disposed out of registry with each other) in the direction perpendicular to the sliding direction, the slanting surface serves as the guide surface so as to correct this misregistration. And besides, since the rear projection and the engagement arm abut against each other through the slanting surface, the pressing force from the rear projection acts on the engagement arm in the direction to easily elastically deform the engagement arm, and therefore the sliding movement can be effected more smoothly.

What is claimed is:

1. A combined-type connector comprising:

at least first and second connector housings;

said first and second connector housings being respectively provided with first and second terminal storage chambers, said first and second connector housings being adapted to stack one on the other;

first partition walls, on said first connecting housings, for defining said first terminal storage chambers;

second partition walls, on said second connecting housings, for defining said second terminal storage chambers;

a rear lock mechanism which engages a rear end portion of said first connector housing with a rear end portion of said connector housing when said first connector housing is located at a connecting position;

wherein first distal end surfaces of said first partition walls are substantially abutted respectively against second distal end surfaces of said second partition walls;

wherein said first connector housing is slidable relative to said second connector housing in a sliding direction parallel to a direction in which each said second partition walls extend;

wherein said first connector housing is slidably moved relative to said second connector housing in said sliding direction to a connecting position; and wherein said rear lock mechanism includes at least one rear projection formed on said first connector housing, said rear projection has been changed to oriented rearwardly to said rear end portion and an outwardly extended portion positioned parallel with said sliding direction, and at least one rear engagement arm formed on said second connector housing, said rear engagement arm having an engagement hole, engageable with said rear projection.

2. A combined-type connector according claim 1, wherein when said rear engagement arm abuts against said rear projection during a sliding movement of said second connector housing, said rear engagement arm is elastically deformed to allow said rear projection to slide; and when said second connector housing slides into said connecting position, said rear engagement arm being elastically deformed into an initial position of said rear engagement arm, so that said rear projection are engaged in said engagement hole.

3. A combined-type connector according to claim 1, wherein said rear engagement arm abuts against said slanting surface of said rear projection during said sliding movement.

4. A combined-type connector according to claim 1 further comprising:

a front lock mechanism which engages a front end portion of said first connector housing with a front end portion of said second connector housing when said first connector housing is located at said connecting position.

5. A combined-type connector according to claim 4, wherein said front lock mechanism includes:

at least one front projection formed on a first connecting surface of said first connector housing, said front projection extending in said sliding direction;

at least one front recess formed in a second connecting surface of a second connector housing, an end of said front recess being open to a front end surface of said second connector housing in said sliding direction.

6. A combined-type connector according to claim 5, wherein said front projection and said front recess cooperatively guide said first connector housing to be slidably moved to said connecting position relative to said second connector housing.

7. A combined-type connector according to claim 6, wherein said front projection and said front recess establish a dovetail engagement.

8. A combined-type connector according to claim 1 further compromising:

a front lock mechanism which positions said first and second connector housings relative to each other in said sliding direction when said first connecting housing is located at said connecting position.

9. A combined-type connector according to claim 8, wherein said front position lock mechanism includes:

at least one position lock projection formed on a first connecting surface of said first connector housing;

said front position lock projection extending in a direction perpendicular to said sliding direction;

at least one position recess formed on a second connecting surface of said second connector housing;

said position recess extending in a direction perpendicular to said sliding direction;

said position lock projection engaged with said position recess at said connecting position.

* * * * *